US005206694A

United States Patent [19]

Ohira et al.

[11] Patent Number: 5,206,694

[45] Date of Patent: Apr. 27, 1993

[54] IMAGE FORMING APPARATUS

[75] Inventors: Tadashi Ohira; Masazumi Ito, both of Osaka, Japan

[73] Assignee: Minolta Camera Kabushiki Kaisha, Osaka, Japan

[21] Appl. No.: 382,181

[22] Filed: Jul. 19, 1989

[30] Foreign Application Priority Data

| | | | |
|---|---|---|---|
| Jul. 20, 1988 | [JP] | Japan | 63-181228 |
| Jul. 20, 1988 | [JP] | Japan | 63-181229 |
| Jul. 20, 1988 | [JP] | Japan | 63-181230 |
| May 12, 1989 | [JP] | Japan | 63-119570 |

[51] Int. Cl.[5] ..... G03G 15/20

[52] U.S. Cl. ..... 355/290; 219/216; 355/282; 355/285

[58] Field of Search ..... 355/203, 204, 208, 285, 355/289, 290, 206; 219/243, 469, 470, 471, 216

[56] References Cited

U.S. PATENT DOCUMENTS

| | | | |
|---|---|---|---|
| 3,588,445 | 6/1971 | Hopkins | 219/216 X |
| 3,926,519 | 12/1975 | Rebres | 355/208 |
| 4,324,486 | 4/1982 | Nishikawa | 219/216 X |
| 4,348,102 | 9/1982 | Sessink | 355/285 |
| 4,349,269 | 9/1982 | Okada | 355/285 |
| 4,385,826 | 5/1983 | Itoh | 219/388 |
| 4,425,494 | 1/1984 | Enomoto et al. | 219/216 |
| 4,480,908 | 11/1984 | Anzai et al. | 355/208 X |
| 4,549,803 | 10/1985 | Ohno et al. | 219/469 X |
| 4,825,242 | 4/1989 | Elter | 219/216 X |
| 4,878,092 | 10/1989 | Arai | 219/216 X |

FOREIGN PATENT DOCUMENTS

| | | | |
|---|---|---|---|
| 0080135 | 12/1977 | Japan . | |
| 0003686 | 1/1985 | Japan | 355/285 |
| 0187364 | 8/1987 | Japan | 355/285 |
| 0206581 | 9/1987 | Japan | 355/285 |
| 62-143067 | 12/1987 | Japan . | |
| 0288876 | 12/1987 | Japan | 355/285 |

*Primary Examiner*—A. T. Grimley
*Assistant Examiner*—J. E. Barlow, Jr.
*Attorney, Agent, or Firm*—Burns, Doane, Swecker & Mathis

[57] ABSTRACT

An image forming apparatus comprises an image forming portion for forming toner images on a sheet of paper, a fixing portion for fixing the toner images on the sheet of paper by heat, and a counter for counting the number of sheets on which images are fixed from the time of turning on of the power. The image forming portion forms toner images on the paper at a low speed until the counter counts a prescribed number. Since the number of sheets to be fixed is reduced at the start of operation, the temperature of the fixing portion is not very much lowered. Namely, the fixing operation can be started when the temperature of the fixing portion reaches a prescribed value. Therefore, the time required for warming up the image forming forming apparatus can be reduced.

17 Claims, 12 Drawing Sheets

IMAGE FORMING APPARATUS

BACKGROUND OF THE INVENTION

1. Field of the Invention

The present invention relates to an image forming apparatus having a heat fixing device and, more specifically, to an image forming apparatus in which fixing immediately after the end of warming up of the apparatus, that is, fixing in the first image forming operation in the morning, can be carried out satisfactorily.

2. Description of the Related Art

Fixing means of an image forming apparatus of particular interest to the present invention is disclosed in U.S. Pat. No. 4,385,826. According to this gazette, a heat roller method is employed for fixing transferred toner images on a sheet of copy paper. At the start of warming up of the apparatus after the power is turned on, the heat roller and the pressing roller are kept still. When the surface temperature of the heat roller reaches a prescribed temperature, both rollers are rotated for a prescribed time period being in contact with each other, whereby the heat roller and the pressing roller are both warmed to a temperature high enough for fixing. The fixing device has been developed to reduce the time required for the rising of the surface temperature of the rollers during warming up and to carry out the fixing operation satisfactorily.

Another fixing apparatus of an image forming apparatus of particular interest to the present invention is disclosed in Japanese Patent Laying-Open No. 62-143067. According to this Laid-Open Invention, when the surface temperature of the fixing roller becomes lower than a prescribed temperature during continuous copying operation, the copying speed is reduced. In this fixing apparatus, the copying operation is continued without interruption, even when the fixing temperature of the fixing apparatus becomes lower than a prescribed temperature during continuous copying operation. However, the operation at the time of power-on is not mentioned at all in the above article.

However, the above described fixing apparatuses have the following drawbacks. In the former fixing apparatus, the pressing roller as well as the heat roller are rotated from the time when the surface temperature of the heat roller reaches a prescribed temperature during warming up after the turning on of the power. When the surface temperature of the heat roller and of the pressing roller reached the aimed temperature for fixing by the heat conduction from the heat roller, the rotation of both rollers is stopped and thus the warming up is completed. Therefore, the copying operation cannot be carried out after the lapse of a prescribed time period after the turning on of the apparatus. Namely, it takes much time to start the copying operation after the turning on of the apparatus. In addition, preparatory rotation of the rollers is suddenly started during warming up of the apparatus, that is, when the copying operation is totally unexpected. Therefore, the user may possibly be surprised.

In the latter mentioned fixing apparatus, the copying operation is not interrupted even if the fixing temperature becomes low during continuous copying operation. However, no consideration is taken for the first copying operation in the morning after the end of warming up.

SUMMARY OF THE INVENTION

Therefore, one object of the present invention is to enable satisfactory fixing operation after a short time of warming up after the turning on of the power in an image forming apparatus.

Another object of the present invention is to prevent interruption of copying operation caused by the lowering of the fixing temperature after the turning on of the apparatus in an image forming apparatus.

A further object of the present invention is to prevent the operation of the apparatus during warming up from surprising the user.

A still further object of the present invention is to prevent lowering of temperature at the fixing portion as much as possible in a first image forming operation in the morning.

The above described objects of the present invention can be attained by an image forming apparatus of the present invention, comprising: an image forming portion forming toner images on a sheet of paper at a prescribed image forming speed; a fixing apparatus for fixing the toner images on the sheet of paper, having a heat roller with a heater for heating the paper and a pressing roller rotatable in contact with the heat roller; a driving apparatus for rotating the heat roller and the pressing roller; a sensor for detecting temperature of the heat roller; a power switch for supplying power to the image forming portion; a power supply apparatus for applying power to the heater after the turning on of the power switch; an inhibiting apparatus for inhibiting operation of the image forming portion and of the driving apparatus after the detection of a prescribed temperature by the sensor; a counter for counting the number of sheets on which images are fixed by the fixing apparatus after the release of inhibition by the inhibiting apparatus; and a controller for lowering the prescribed image forming speed per unit time period until the value of the counter reaches a prescribed value.

The image forming apparatus of the present invention comprises the above described components. In a prescribed time period after the turning on of the power, the image forming speed per a unit time period is reduced. Therefore, the temperature is not very much lowered after the fixing operation. Therefore, the fixing operation can be started when the temperature of the fixing portion reaches a prescribed level. Consequently, satisfactory fixing operation is enabled after a short time of warming up after the turning on of the image forming apparatus.

In accordance with a preferred embodiment of the present invention, the speed for transferring the sheets of paper to the fixing apparatus is changed, so as to prevent the lowering of the temperature at the fixing portion. Therefore, the time required for warming up the apparatus can be reduced by a simple structure in the image forming apparatus.

In accordance with another aspect of the present invention, an image forming apparatus comprises an image forming portion for forming toner images on a sheet of paper in response to an image forming starting signal; a fixing apparatus for fixing the toner images on the sheet of paper, having a heat roller with heater for heating the sheet of paper and a pressing roller provided in contact with the heat roller; a driving apparatus for rotating said heat roller and the pressing roller; a sensor for detecting the temperature of said heat roller; a power supply apparatus for supplying power to the heating means; a power switch for supplying power to the image forming apparatus; a print switch for outputting the image formation starting signal to the image forming apparatus; an inhibiting apparatus for inhibiting the operation of the image forming apparatus after the turning on of the power switch until a detection of a prescribed temperature by the sensor; and a controller for operating the driving apparatus for a prescribed time period before the operation of the image forming apparatus, when the image forming starting signal is inputted for the first time after the release of inhibition by the inhibiting apparatus.

In accordance with another aspect of the present invention, the image forming apparatus is not operated until the fixing is enabled after the turning on of the power. The image formation and the driving of the fixing apparatus are started after the fixing operation is enabled. Therefore, no part of the apparatus is moved until the start of the actual image formation. Accordingly, the user will not be surprised during warming up of the apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be hereinafter described with reference to the appended drawings, on a copying apparatus as an example of the image forming apparatus.

Figure 1:
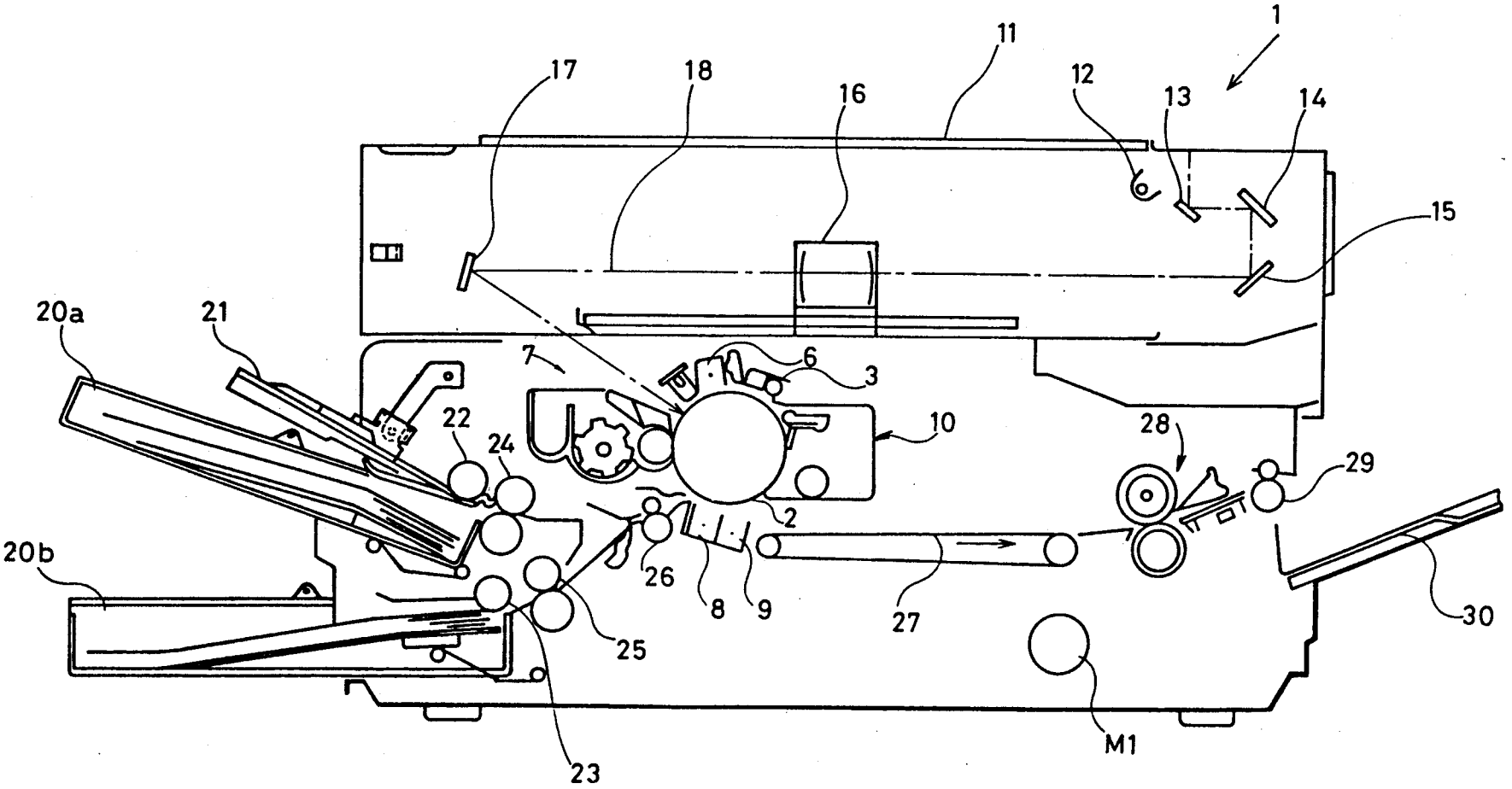
FIG. 1 is a schematic cross sectional view of a body of a copying machine as an example of an image forming apparatus.

Referring to FIG. 1, the body 1 of the copying machine to which the present invention is applied comprises a photoreceptor drum 2 which can be rotary driven in the counterclockwise direction provided at the center, a main eraser lamp 3, a corona charger 6, a developing apparatus 7, a transfer charger 8, a separating charger 9 for separating sheets of paper on which images are transferred, a blade type cleaner apparatus 10 and so on provided around the photoreceptor drum 2. A photosensitive material (for example, selenium) is applied on the surface of the photoreceptor drum 2. The drum is illuminated by the eraser lamp 3 in every copying operation charged by the corona charger 6, and thereafter images from an optical system, which will be described in the following, are exposed. A motor Ml drives the photoreceptor drum 2 and the like.

The optical system is arranged below a platen glass so as to scan the original images. The optical system comprises a light source 12, a first mirror 13, a second mirror 14, a third mirror 15, a projecting lens 16 and a fourth mirror 17. The images of an original are formed through respective mirrors 13, 14, and 15 and 17 onto the photoreceptor drum 2, as represented by a chain dotted line 18.

On the left side of the body of the copying machine 1, an automatic paper feeding cassette **20*a* is arranged at an upper paper feeding inlet, an automatic paper feeding cassette 20*b* is arranged at a lower paper feeding inlet and a manual feeding portion 21 is arranged above the automatic paper feeding cassette 20*a*. The sheets of copy paper in the automatic paper feeding cassettes 20*a*, 20*b* and in the manual paper feeding portion 21 are selectively fed to the body of the copying machine 1 by the respective paper feeding rollers 22 and 23, pass through the respective feeding roller pairs 24 and 25 to a timing roller 26** which is in a pressure contact state to be kept in a standby state.

At the time of image transfer, the sheet of copy paper fed by the timing roller 22 is brought into contact with the photoreceptor drum 2 at the transferring portion. The toner images are transferred onto the sheet of copy paper by corona discharge of the transfer charger 8. Thereafter, the sheet of copy paper is separated from the photoreceptor drum 2 by the corona discharge of the separating charger 9 and by the force to go straight derived from the strength of the sheet itself. Thereafter, the sheet of copy paper is transferred in the right in accordance with the rotation of conveying belt 27 in the clockwise direction, while the sheet is attracted to the conveying belt 27 by air suction means, not shown provided on the belt. The toner images are melted and fixed on the sheet as the sheet of paper passes through the fixing apparatus 28 comprising a pair of upper and lower fixing rollers. Thereafter the sheet of copy paper passes through a discharging roller pair 29 to be discharged to a tray 30 out of the body of the copying machine 1 or to a sorter or the like, not shown.

Figure 2:
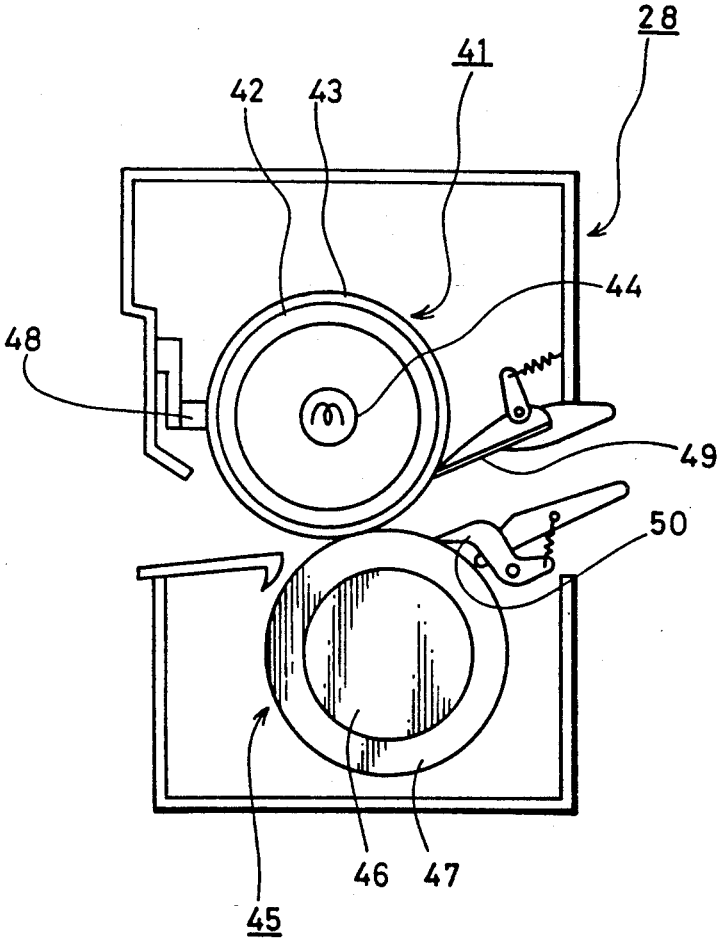
FIG. 2 is an enlarged cross sectional view of a fixing apparatus.

Referring to FIG. 2, the fixing apparatus 28 comprises a heat roller 41 which is a fixing upper roller and a pressing roller 45, which is a fixing lower roller.

The heat roller 41 comprises a coating layer 43 of Teflon provided on an outer periphery of a hollow rotary axis 42 made of metal, so that the paper is easily separated therefrom, and a fixing heater lamp 44 as the heating means provided in the hollow rotary axis 42. The pressing roller 45 comprises a silicon rubber coverage 47 provided on the outer surface of a solid rotary axis 46 made of metal and is brought into contact with the fixing upper roller 41 by means of springs provided on axis supporting portions on the opposite ends.

A fixing thermister 48 is provided on the outer periphery of the heat roller 41 for detecting the surface temperature of the heat roller 41.

Separation claws 49 and 50 are provided on the right side of the fixing apparatus 28 in order to prevent the sheet of copy paper being wrapped around the heat roller 41 and the pressing roller 45.

Figure 3:
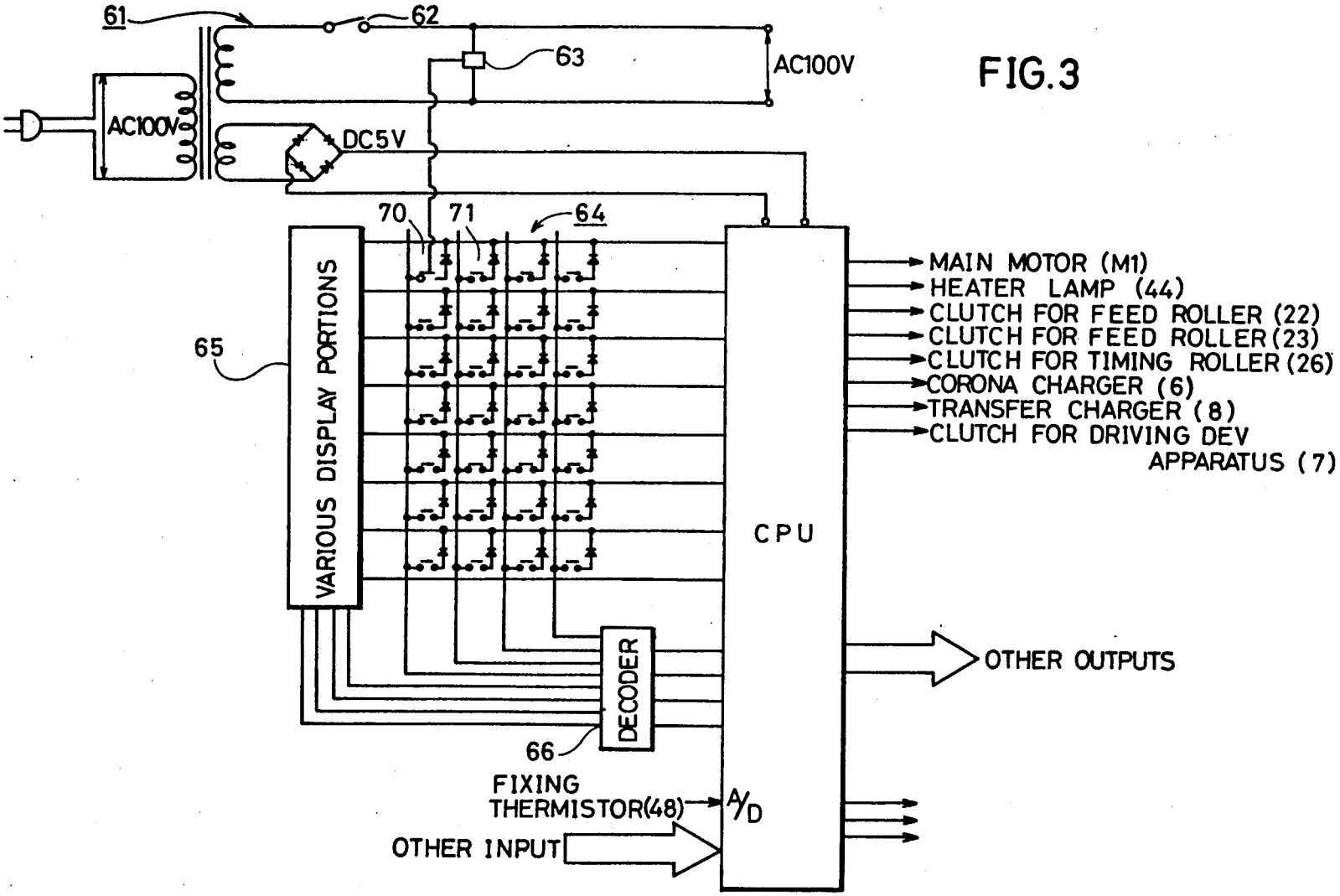
FIG. 3 is a schematic diagram of a control circuit in an image forming apparatus of the present invention.

Referring to FIG. 3, the control circuit of the apparatus of the present embodiment will be briefly described. When a socket of the copying apparatus is connected to a power supply of AC 100V, operation of a CPU (Central Processing Unit) including an A/D converter is started regardless of the ON/OFF state of the power switch 62, by the DC 5V power supply in the power supply circuit 61. When the power switch 62 is turned on, a main switch 70 of a switch matrix 64 is turned on by a relay 63. The reference numeral 71 represents a print button for inputting the copy operation starting instruction. The switch matrix 64 comprises various displaying portions 65. Input through various switches constituting the switch matrix 64 are inputted time divisionally to the CPU by using a decoder 66. A detected temperature signal of the fixing thermister 48 is inputted to an analog port of the CPU, which is A/D converted to be processed as temperature data. Information in association with the control of the copying machine is inputted to other input ports.

Connected to the various output ports of the CPU are transistors (not shown) for switching driving of the main motor M1 of the body of the copying machine, the corona charger 6, the transfer charger 8, the heater lamp 44 of the fixing apparatus 28, the clutch for the fixing apparatus driving the developing apparatus 7, clutches for the paper feeding rollers 22 and 23 and of the clutch for the timing roller 26. Other outputs are provided as information for controlling peripheral circuits.

Figure 4:
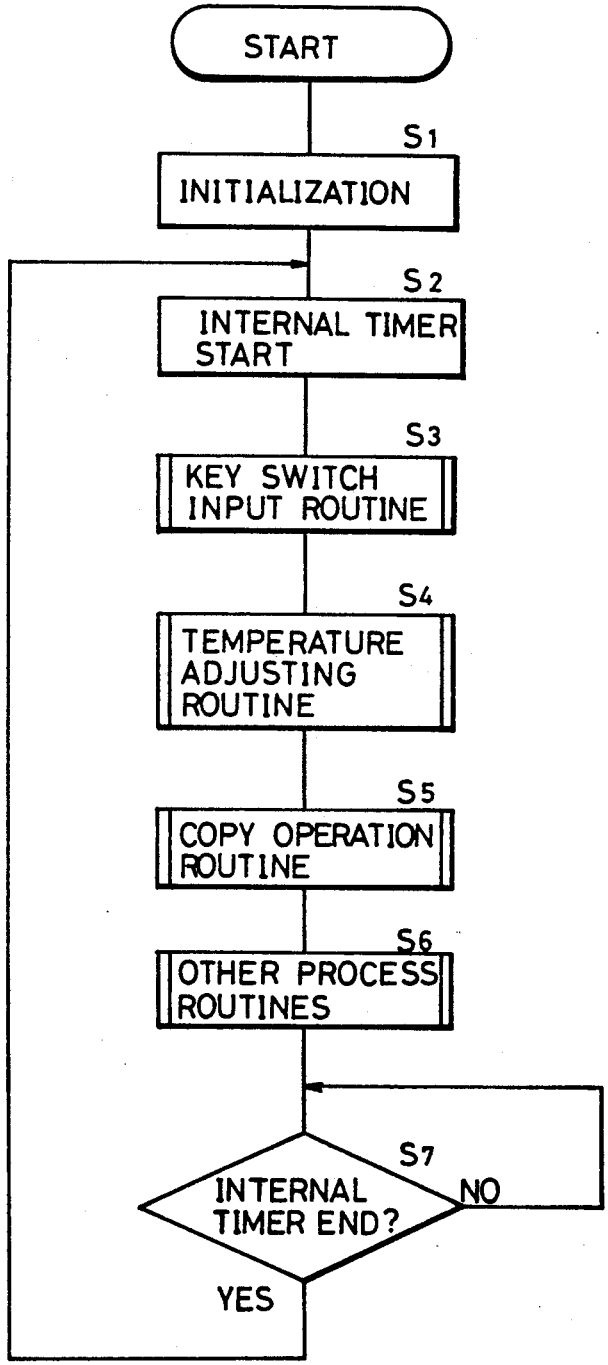
FIG. 4 is a flow chart of a main routine of the image forming apparatus in accordance with the present invention.

Referring to FIG. 4, a main routine of the CPU controlling the whole copying machine will be described.

When the CPU is reset and the program is started, the RAM is cleared, the CPU is initialized to set values in respective registers, and initialization is carried out for setting the copying machine to an initial mode in the step S1 (hereinafter the term step will be omitted).

In S2, an operation of an internal timer contained in the CPU in which routine time is set in the initialization is started. In the following steps S3 to S6, a subroutines including a key.switch input routine, a temperature adjusting routine, a copying operation routine and other processing routines are successively called. When the processes of all the subroutines are completed, each routine is terminated at the end of the operation of the internal timer set at the start (S7).

Various timers employed in respective subroutines are counted by using the length of one routine. The operation of the timers can be determined by checking how many times this one routine is counted by using the values of the timers.

Figure 5:
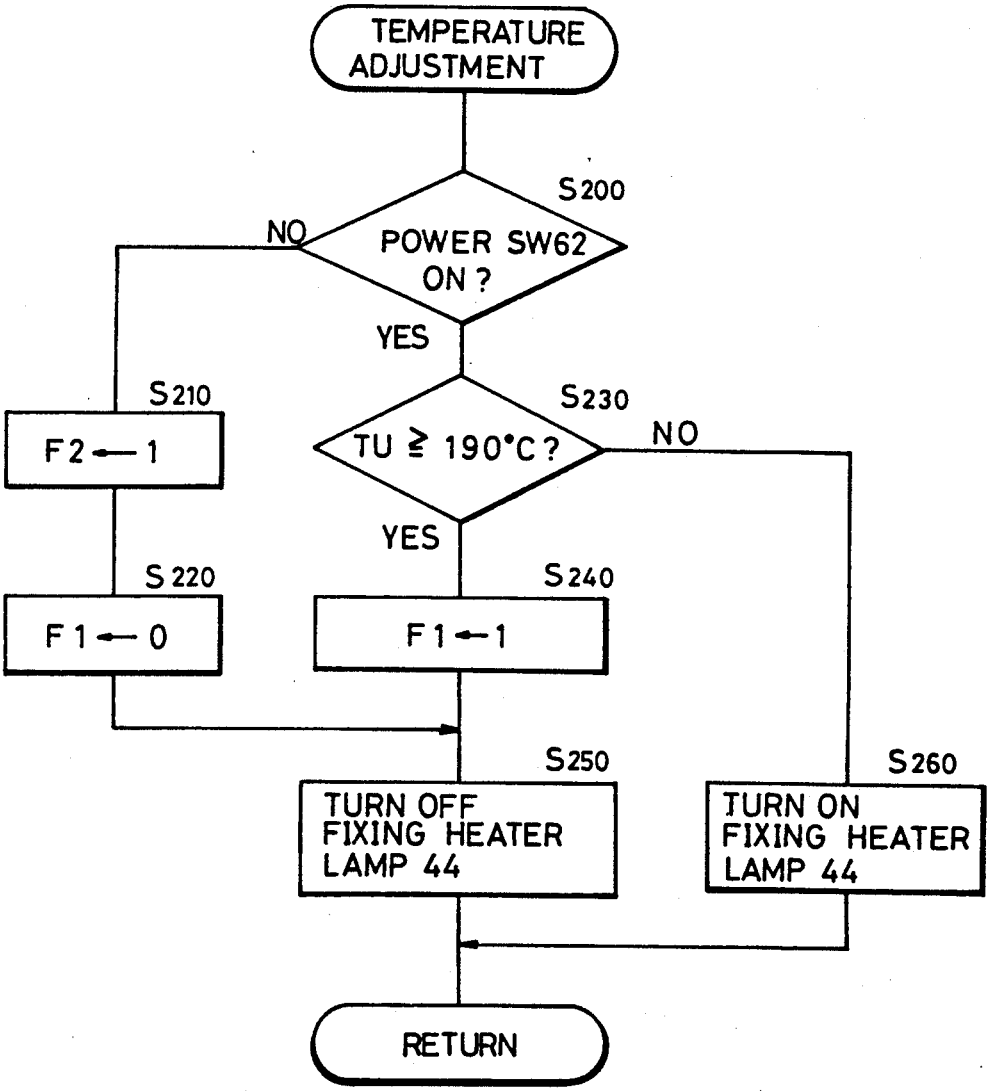
FIG. 5 is a flow chart of a temperature adjusting routine of the image forming apparatus in accordance with the present invention.

The temperature adjusting routine will be hereinafter described with reference to FIG. 5.

First, in the step S200, whether or not the power switch 62 is ON is determined. If it is OFF, a flag F2 is set to "1" in S210 and a flag F1 is reset to "0" in S220. The flag F2 stores the OFF state of the power switch 62. The flag F1 indicates that the warming up is completed and the machine is in the temperature adjusted state at which the temperature is the aimed temperature for fixing, i.e. 190° C.

Thereafter, the flow proceeds to S250 in which the fixing heater lamp 44 is turned off, and this subroutine is terminated.

Even if the power is off, the CPU is backed up by the direct power supply of DC 5V, as described with reference to the control circuit.

If the power switch 62 is in the ON state in S200, the program proceeds to S230 in which whether the detected temperature TU of the fixing thermister is higher than the aimed temperature 190° C. for fixing or not is determined. If the temperature is no less than 190° C. (YES), the flow proceeds to S240 in which the flag F1 is set to "1" and the flow further proceeds to S250 in which the fixing heater lamp 44 is turned off. If the temperature TU is lower than 190° C. in the step S230, then the flow proceeds to S260 in which the fixing heater lamp 44 is turned on, and the subroutine is terminated.

(I) First embodiment of the copying operation

A routine of a first embodiment of the copying operation will be described in the following with reference to FIG. 6.

In the step S300, whether or not the flag F1 is set at "1" is checked. If F1=0, it means that the power switch 62 is on and the warming up has not yet been completed, so that the flow returns to the main flow and this subroutine is terminated.

If the flag F1=1, it means that the warming up is completed and the copying operation can be started. Accordingly, the flow proceeds to S310 in which whether there is an on edge of the print button 71 (a transition from the OFF state to the ON state of the switch) or not is checked. If there is the ON edge, the program proceeds to S320 in which whether or not the flag F2 is set at "1" is determined. If F2=1, it means that the print button 71 is pressed for the first time after the turning on of the power switch 62, namely, the first copying operation in the morning is to be started. In that case, the program proceeds to S330 in which the copying operation for a prescribed number has been terminated or not is checked. If not, time for determining paper feeding interval is set by a second timer in the step S340, and then the program proceeds to S370 in which a subroutine for image forming operation is called to start copying. If the copying operation of the prescribed the number has been terminated in the said step S330, the program proceeds to S350 in which the time for determining paper feeding interval is set by the first timer, the flag F2 is reset to "0" in the step S360 and the subroutine for the image forming operation is called in S370 to start copying.

The timer value of the first timer for setting the paper feeding interval defines the paper feeding interval in the normal copying operation. The timer value of the second timer determines a wider paper feeding interval than in the normal copying operation. More specifically, in a copying operation using an A4 size sheet of copy paper fed transversely for equal scale magnification, the space between the trailing edge of the sheet of copy paper and the leading edge of the next sheet of copy paper is 200 mm when the paper feeding interval is set by the first timer, while the space is 300 mm when it is set by the second timer.

If the copying operation is not continuously carried out and the number of copies provided is smaller than the prescribed number, the set number is determined in the following manner. Namely, the first number of copies is inputted to a counter connected to the CPU. In the next copying operation, the number of copies at that time is added to the value stored in the counter. The set number is compared with the added value.

The values of the paper feeding intervals set by the first and second timers are used in the image forming operation routine of S370.

Meanwhile, if the flag F2=0 in S320, it means that the image forming operation has been carried out after the turning on of the power switch 62 by the time of this pressing of the print button 71. Therefore, the program directly proceeds to S370 to carry out the image forming operation.

If there is no ON edge of the print button 71 in S310, the program proceeds to S380 and if the image forming operation is being carried out, whether or not the image forming operation for the selected number of sheet has been completed is checked. If not, the steps S320 to S370 are executed. If the image forming operation for the set number has been completed, the program proceeds to S390 in which the image forming operation is terminated. Therefore, if the copying machine is in a normal standby state, the flow follows the steps of S380 to S390 and to return to the main flow.

In the above described copy operation routine, the warming up of the apparatus after the turning on of the power supply power switch 62 is carried out by turning on only the fixing heater lamp 44 which is the heating means, without rotating the heat roller 41 and the pressing roller 45 of the fixing apparatus 28. When it is detected by the fixing thermister 48 that the temperature of the heat roller 41 has reached the aimed temperature 190° C. fixing, the warming up is completed. Therefore, the warming up of the apparatus can be carried out quietly. When the print button 71 is pressed for the first time for carrying out the copying operation, namely, in the first copying operation in the morning, the copying operation is carried out with the paper feeding interval set wider until the end of copying of a prescribed number. After the end of copying for the prescribed number, the copying operation is carried out with the normal paper feeding interval. By doing so, the temperature distribution of both rollers is made uniform while the copying paper is not fed, by the heat conduction derived from the rotation of the heat roller 41 and the pressing roller 45 in contact therewith, thereby enabling satisfactory fixing operation of the fixing apparatus. During this period, the fixing heater lamp 44 contained in the heat roller 41 is ON.OFF controlled to maintain the aimed temperature for fixing, by the temperature adjusting operation routine.

The paper feeding interval is made wider until the end of the copying operation for a prescribed number of sheets from the following reason. Namely, when the surface temperature of the fixing upper roller reaches a temperature enabling fixing and the images are fixed on the copy paper, the heat on the fixing upper roller 41 is carried away by the fixing lower roller 45 and the sheet of copy paper. After the copying machine enters the normal operation, the heat carried out by the fixing lower roller 45 and the sheet of the copy paper can be supplied from the fixing upper roller 41. However, immediately after the turning ON of the power, the heat stored in the fixing lower roller 45 is not sufficient to make up for the heat quantity to be carried out, although heat is supplied from the fixing upper roller 41. Therefore, in the first embodiment of the present invention, the paper feeding interval is made wider until the fixing apparatus 28 reaches a prescribed saturation temperature after the start of power supply, namely, until the end of copying operation for the prescribed number of sheets, in order to reduce the heat quantity carried out by the sheet of paper per a unit time period. By doing so, unlike the prior art, the fixing operation can be started before the fixing apparatus 28 as a whole reaches the saturation temperature.

Consequently, the time required for warming up of the copying machine can be reduced.

(II) Second embodiment of the copying operation

A plurality of modifications of the copying operation will be described in the following. Each of the modifications will be described with reference to flow charts, in which the same step are represented by the same reference numerals, and only the differences will be described.

Figure 6:
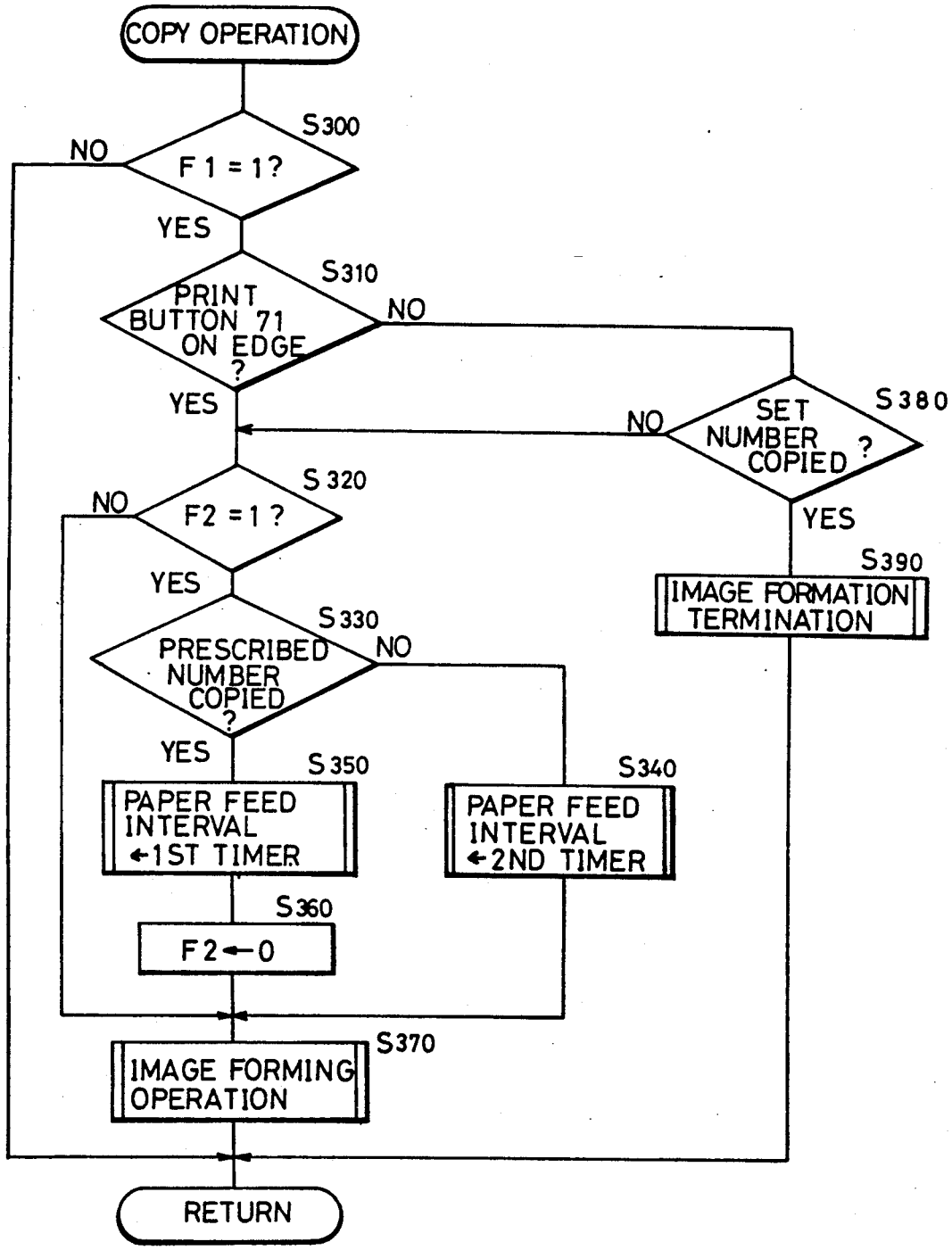
FIG. 6 is a flow chart showing a copy operation routine of a first embodiment of the present invention.
Figure 7:
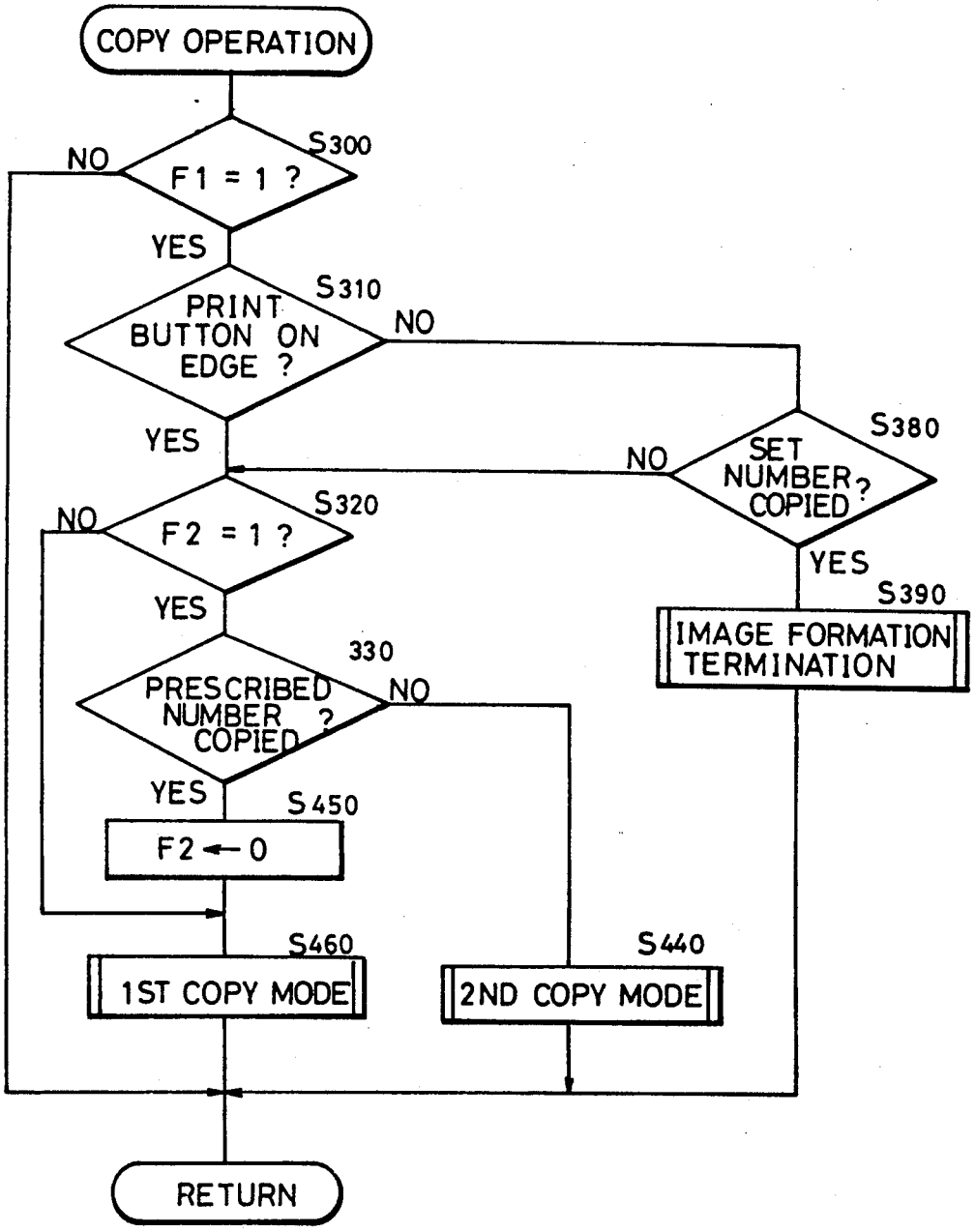
FIG. 7 is a flow chart showing a copy operation routine of a second embodiment of the present invention.

Referring to FIG. 7, a second embodiment of the copying operation of the present invention will be described. The flow chart corresponds to the flow chart of FIG. 6 described in association with the first embodiment, wherein the steps S340, S350 and S370 are changed and the order of the step S360 is changed.

In S320, the flag F2 is checked. If F2=0, the program jumps to the step S460 and the copying operation is started in a first copying mode, which will be described later. If F2=1, it means that the print button 71 is pressed for the first time after the turning on of the power switch 62, so that the program proceeds to S330 in which whether or not the copying operation for a prescribed number has been terminated is checked. If not, the image forming operation is started in a second copying mode in S440. If the copying operation for the prescribed number has been terminated in S330 (YES), the program proceeds to S450 in which the flag F2 is reset to "0", and the program further proceeds to S460 in which the image forming operation is started in the first copying mode.

In the first copying mode, the copying operation is carried out with a system speed for a normal copying operation, which is about 200 mm/sec when a sheet of A4 size copy paper is fed transversely for the copying operation of the equal scale magnification. In the second copying mode, the system speed is set lower than in the first copying mode, which is about 150 mm/sec. In the second copying mode, the system speed is lowered in accordance with the total adjustment of the scanning speed of a scanning system, the paper feeding interval, the intensity of the exposure lamp and so on.

Since the image forming operation is carried out in the respective copying modes, the step of the image forming operation shown in S370 of the flow chart of FIG. 6 can be omitted.

In this embodiment, the warming up can be carried out quietly. At the same time, in the first copying operation in the morning after the end of the warming up, the copying operation for a prescribed number of sheets is carried out with the system speed reduced. The heat conduction from the heat roller 41 to the pressing roller 45 in the fixing apparatus 28 is made relatively faster, so that the temperature distribution of the both rollers are made uniform in a shorter time period, enabling satisfactory fixing operation.

The prescribed the number set for the copying operation after the end of the warming up in respective embodiments described above is about 10, when A4 size copy paper is fed transversely.

(III) Third embodiment of the copying operation

Figure 8:
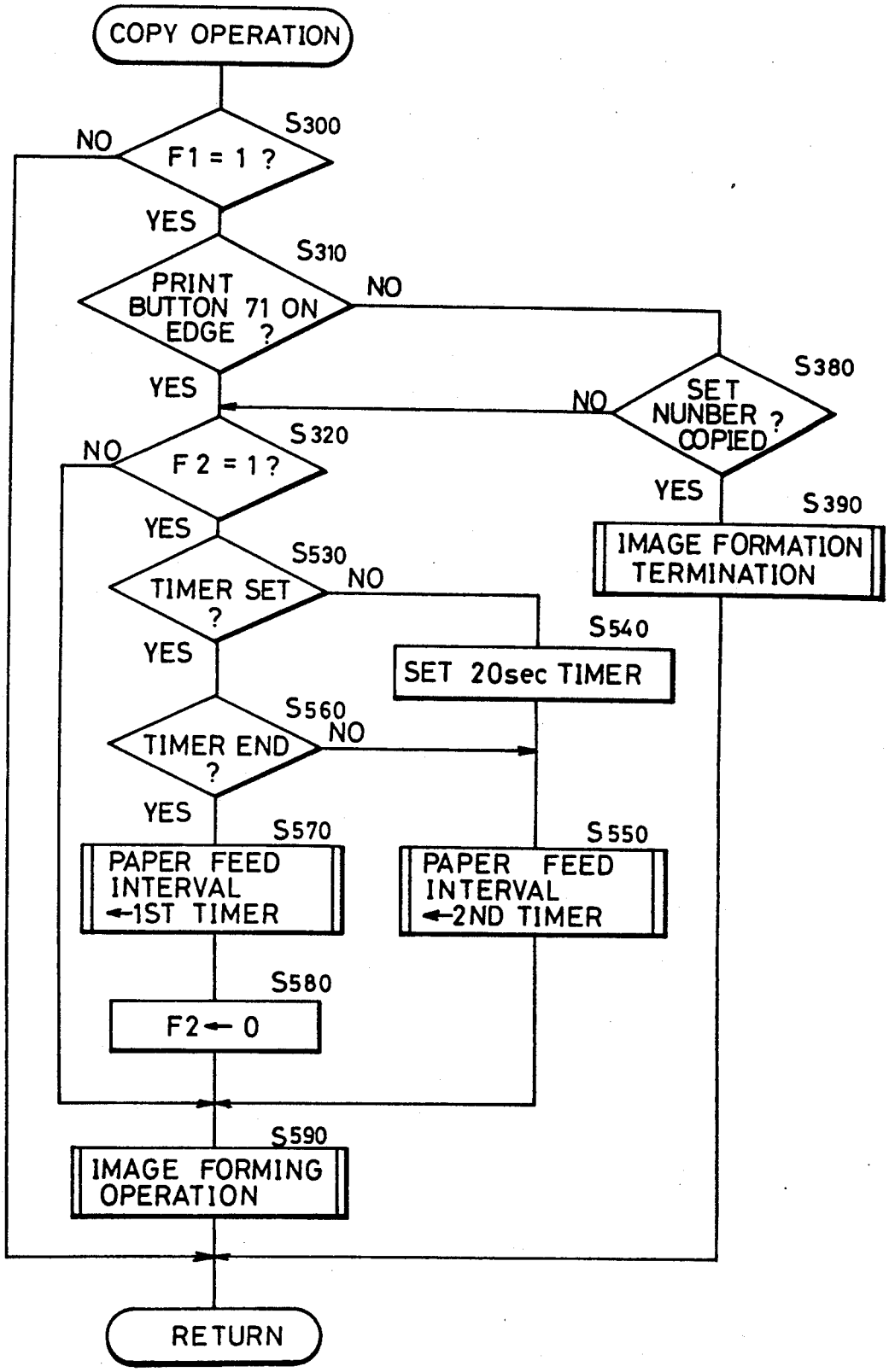
FIG. 8 is a flow chart showing a copy operation routine of a third embodiment of the present invention.

Referring to FIG. 8, the third embodiment of the copying operation will be described. In the third embodiment, the speed for copying is reduced until the lapse of a prescribed time period after the end of the warming up of the image forming apparatus.

If the flag F2=1 in S320, it means that the print button 71 is pressed for the first time after the turning on of the power switch 62, namely, the first copying operation in the morning. Therefore, the program proceeds to S530 in which whether or not the timer is set for the prescribed time period for carrying the copying operation at a lower speed is determined. If the timer has not yet been set, 20 sec is set in a timer in S540, the paper feeding interval is set by the second timer in S550, and the subroutine for the image forming operation is called in S590 to start the copying operation.

If the timer has been set in the step S530, the program proceeds to S560 in which whether or not the set 20 sec timer operation has been terminated or not is checked. If the operation of the timer has been terminated, the paper feeding interval is set by the first timer, the flag F2 is reset in the step S580, and the subroutine for the image forming operation is called in S390 to start copying. If it is NO in S560, the program proceeds to S550.

While the first timer is used for setting the paper feeding interval, the paper is fed with the interval for the normal copying operation. While the second timer is used, the paper is fed with the interval wider than in the normal copying operation. The paper feeding intervals are the same as in the first embodiment. If the number of copies provided by one copying operation is smaller than the prescribed set number, the number of copies is added to the number of copies in the next operation, as in the first embodiment.

(IV) Fourth embodiment of the copying operation

Figure 9:
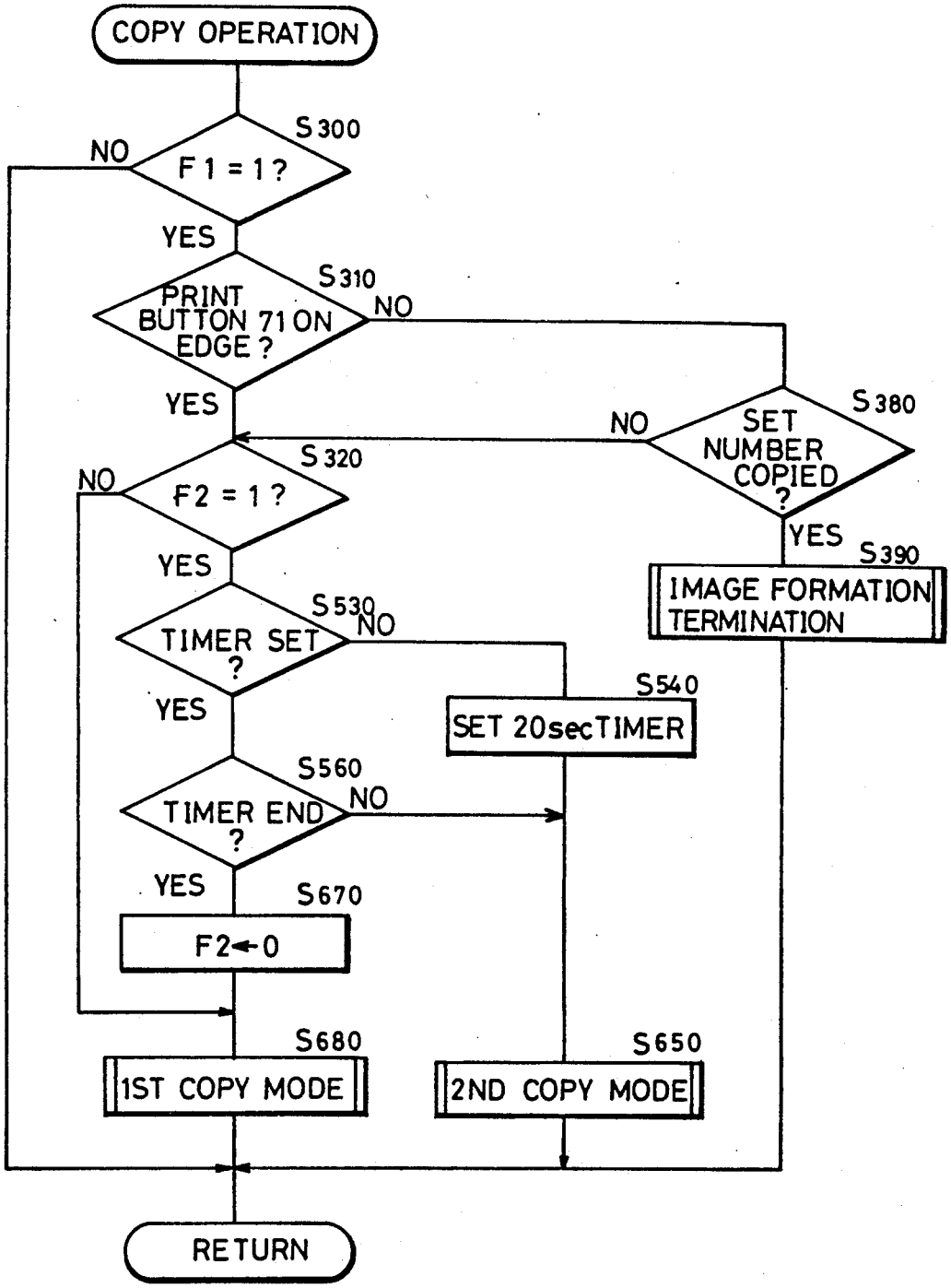
FIG. 9 is a flow chart showing a copy operation routine of a fourth embodiment of the present invention.

The fourth embodiment of the copying operation will be described in the following with reference to FIG. 9. Compared with the third embodiment, the speed of copying is reduced while a prescribed timer is set in the fourth embodiment. Namely, the relation between the fourth and the third embodiments is the same as that of the second embodiment and the first embodiment.

The flag F2 is checked in S320 and if F2=0, the program jumps to S680 and the copying operation is started in the first copying mode, which will be described later. When F2=1, then it means that the print button 71 is pressed for the first time after the turning on of the power switch 62, so that the program proceeds S530 to determine whether or not the timer has been set. If not, the program proceeds to S540 in which 20 sec is set in a timer, and the image forming operation is started in a second copying mode in S650. If the timer has been set in S530, the program proceeds to S560 to determine whether or not the operation of the timer has been completed. If the operation has been completed, the program proceeds to S670 in which the flag F2 is reset to "0", then the image forming operation is started in the first copying mode in S680.

The first and second copying modes are the same as in the second embodiment.

In the third and fourth embodiments, the warming up of the copying machine is carried out quietly, and the copying operation is carried out with lowered system speed until a prescribed the time period has passed in the first copying operation in the morning after the end of warming up. The heat conduction from the heat roller 41 to the pressing roller 45 in the fixing apparatus 28 is made relatively faster, and the temperature distribution of the both rollers are made uniform in a shorter time period, enabling satisfactory fixing operation.

(V) Fifth embodiment of the copying operation

Figure 10:
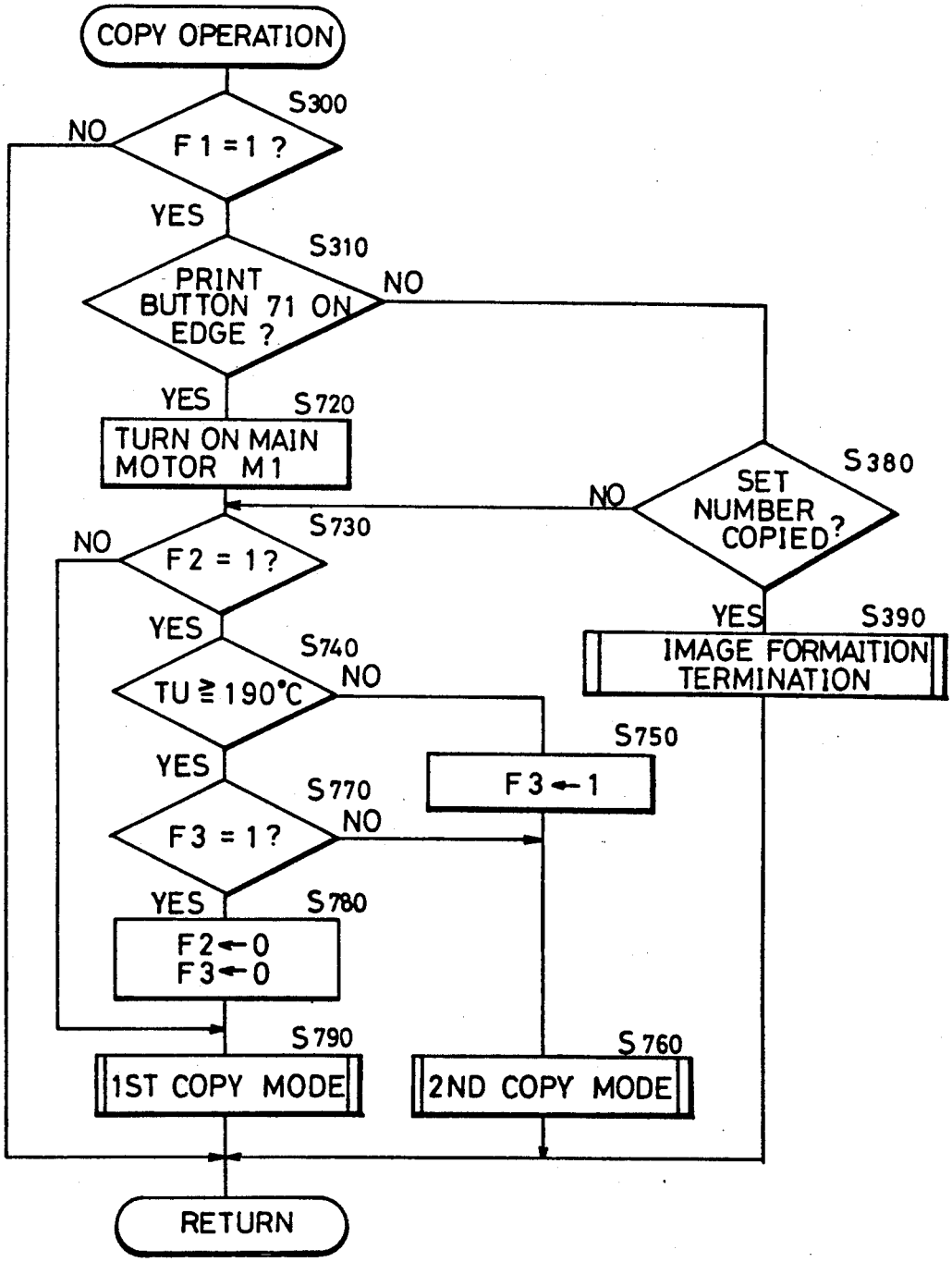
FIG. 10 is a flow chart showing a copy operation routine of a fifth embodiment of the present invention.

The fifth embodiment of the copying operation will be described in the following with reference to FIG. 10. In the fifth embodiment, the speed of copying is lowered until the surface temperature of the heat roller 41 reaches a prescribed temperature after the end of warming up of the image forming apparatus.

In S310, when an ON edge of the print button 71 is detected, the program proceeds to S720 in which the main motor M1 is started, the heat roller 41 and the pressing roller 45 of the fixing apparatus 28 are rotated and the fixing heater lamp 44 is turned on. In the next step S730, whether or not the flag F2 is set at "1" is determined. If F2=1, it means that the print button 71 is pressed for the first time after the turning on of the power switch 62, that is, the first copying operation in the morning. Therefore, the program proceeds to S740 in which whether the detected temperature TU of the fixing thermister 48 is no less 190° C. or not is checked, the thermister detecting the surface temperature of the heat roller 41. If the temperature is lower than 190° C., then the flag F3 is set to "1" in S750, and the program proceeds to S760 in which the copying operation is started in the above described second copying mode. If the temperature is no less than 190° C., then the program proceeds S370 in which whether or not the flag F3 is set at "1" is determined. If F3=0, then the program proceeds to S760 to carry out the copying operation in the second copying mode. If F3=1, the program proceeds to S780 in which the flags F2 and F3 are reset to "0", and thereafter the flow proceeds to S790 to start the copying operation in the above described first copying mode.

The above mentioned flag F3 is provided to indicate the following condition. When the power switch 62 is turned on, the warming up is terminated and the main motor is turned on to start the rotation of the heat roller 41 and the pressing roller 45, then the surface temperature of the heat roller 41 once becomes lower than 190° C. by the heat conduction from the heat roller 41 to the pressing roller 45. The flag is provided for confirming this phenomenon and to ensure that the normal copying operation (in the first copying mode) is not carried out until the surface temperature of the heat roller 41 becomes higher than 190° C. again. More specifically, in taking a first copy in the morning after the end of warming up of the machine, when the surface temperature of the heat roller is lower than 190° C., and when the surface temperature of the heat roller is no less than 190° C. but the flag F3 is not set to "1", then the copying operation is carried out in the second copying mode.

Meanwhile, if the flag F2=0 in S730, it means that the warming up has been terminated and the copying operation has been carried out in the first copying mode after the turning on of the power switch 62 by the time of pressing the print button 71 this time. Therefore, the program directly proceeds to S390 to start the copying operation in the first copying mode.

The paper feeding intervals may be controlled as described above dependent on the temperature.

In the fifth embodiment, the warming up of the machine after the turning on of the power switch 62 is carried out by turning on only the fixing heater lamp 44 serving as the heating means, without rotating the heat roller 41 and the pressing roller 45 of the fixing apparatus 28. The warming up is terminated when the fixing thermister 48 detects that the aimed temperature 190° C. of the heat roller 41 is reached. Therefore, the warming up can be quietly carried out. Thereafter, when the print button 71 is pressed for the first time, that is, in the first copying operation in the morning, the fixing heater lamp 44 is turned on, and the main motor M1 is driven to rotate the heat roller 41 and the pressing roller 45 being in contact therewith. Until the surface temperature of the heat roller 41 which once become lower than 190° C. is again raised to be no less than 190° C., the copying operation is carried out with the number of copies per unit time period reduced than in the normal copying operation. The time of contact between heat roller 41 with the pressing roller 45 is relatively increased. Therefore, heat conduction between both rollers is accelerated and the temperature distribution is made uniform. Since the normal copying mode is started after the surface temperature of the heat roller 41 is raised to be no less than 190° C., the fixing of the images can be satisfactorily carried out. During this period, the fixing heater lamp 44 contained in the heat roller 41 is ON.OFF controlled to maintain the aimed temperature for fixing by the temperature adjusting operation routine.

(VI) Sixth embodiment of the copying operation

The foregoing are the main embodiments of the copying operation of the copying machine to which the image forming apparatus in accordance with the present invention is applied. In addition to the above described embodiments, the following embodiments may be employed.

Figure 11:
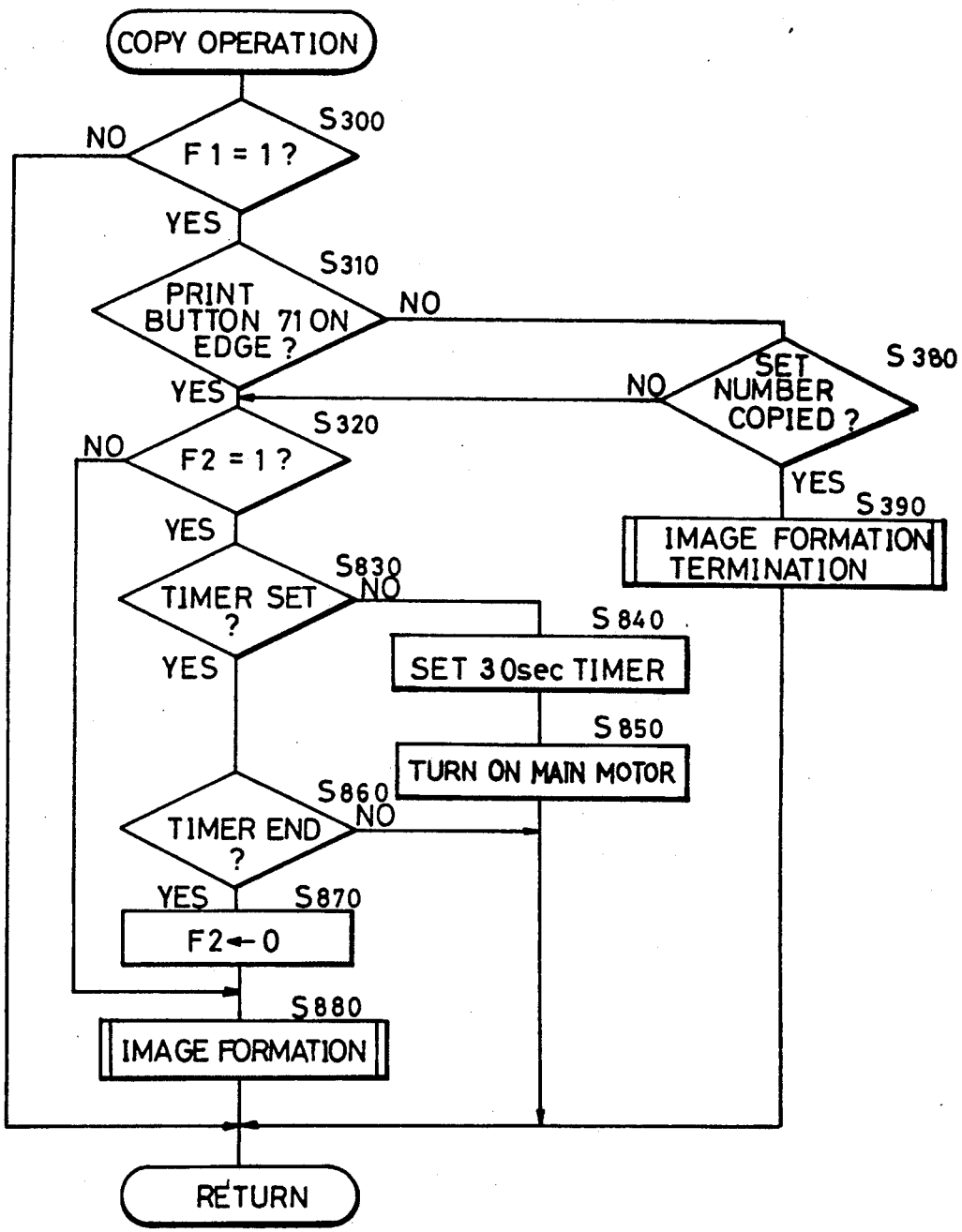
FIG. 11 is a flow chart showing a copy operation routine of a sixth embodiment of the present invention.

The sixth embodiment of the copying operation will be described with reference to FIG. 11. In the sixth embodiment, the heat roller 41 and the pressing roller 45 are rotated for a prescribed time period after the turning on of the print switch, after the end of warming of the image forming apparatus. By doing so, the heat is transmitted from the heat roller 41 to the pressing roller 45. Therefore, image forming operation is inhibited in this time period.

If F2=1 in S320, it means that the print button 71 is pressed for the first time after the turning on of the power switch 62, namely, the first copying operation in the morning. Therefore, the program proceeds to S830 to check the state of the timer. The set value is the prescribed time period in which the image formation is inhibited. If the timer has not yet been set, then a 30 sec is set in a timer in S340, and the main motor is turned on in S850 to rotate the heat roller 41 and the pressing roller 45 of the fixing apparatus 28. If the timer has been set in S830, then whether or not the operation of the timer is terminated is checked in S860, and if not, this subroutine is terminated. If the operation of the timer has been terminated, the flow proceeds to S870 in which the flag F2 is reset to "0", and the subroutine of the image forming operation is called in S880 to start copying.

Meanwhile, if the flag F2=0 in S320, it means that the image forming operation has been carried out after the turning on of the power switch 62 until the pressing of the print button 71 at this time, so that there is no need to rotate the rollers of the fixing apparatus 28 for preparation, and accordingly, the program directly proceeds to S880 to carry out the image forming operation.

(VII) Seventh embodiment of the copying operation

Figure 12:
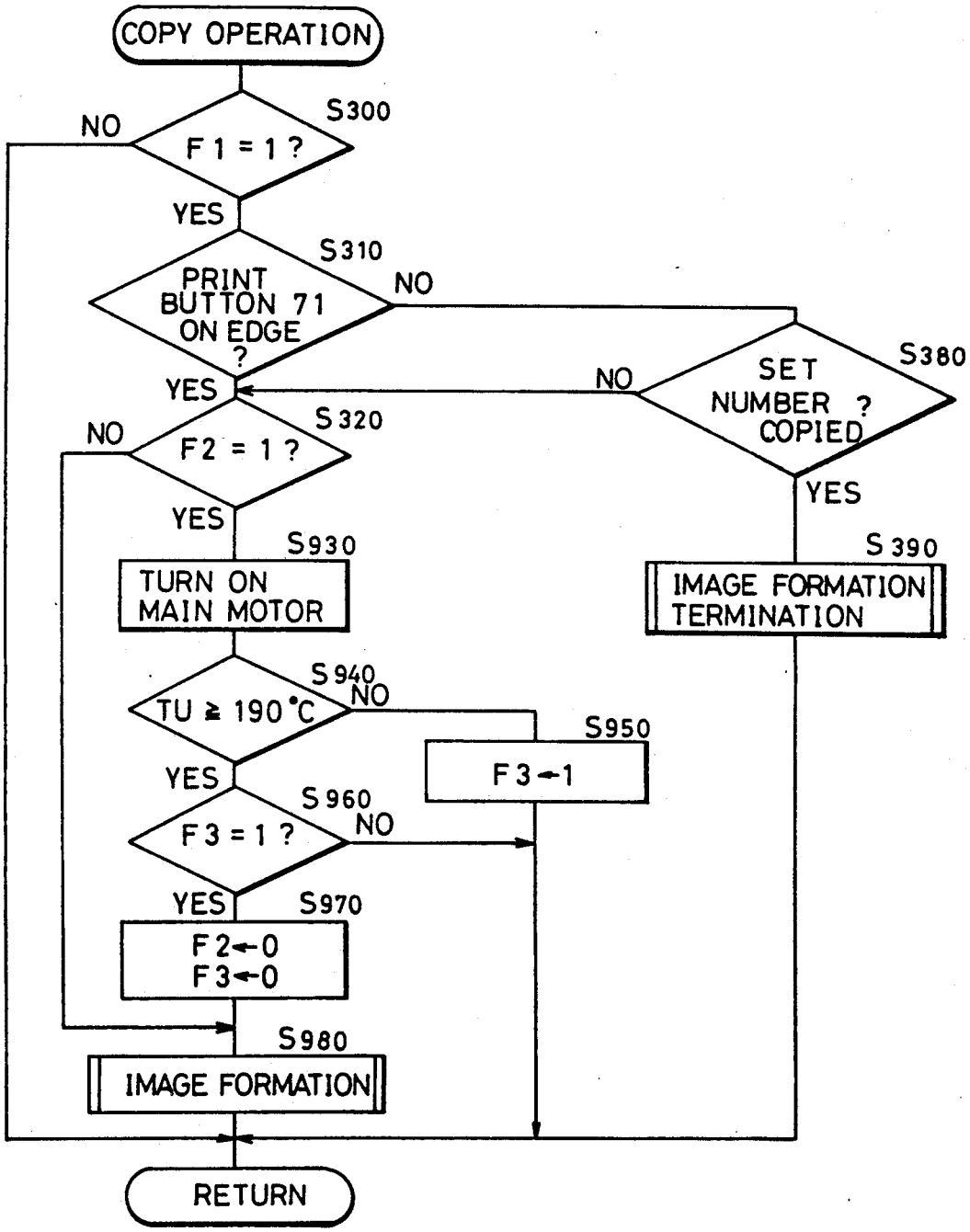
FIG. 12 is a flow chart showing a copy operation routine of a seventh embodiment of the present invention.

The seventh embodiment of the copying operation will be described in the following with reference to FIG. 12. In the seventh embodiment, the image forming operation is inhibited until the surface temperature of the heat roller 41 reaches a prescribed temperature after the turning of the print switch, after the end of warming up of the image forming apparatus. This embodiment is the same as the fifth embodiment except that the image formation is inhibited.

If F2=1 in the step S320, it means that print button 71 is pressed for the first time after the turning on of the power switch 62, so that the main motor is turned on to rotate the heat roller 41 and pressing roller 45 of the fixing apparatus 28. Thereafter, the flow proceeds to S940 to determine whether or not the surface temperature TU of the heat roller 41 is no less than 190° C. If it is lower than 190° C., then the flag F3 is set to "1" in S950 and this subroutine is terminated. If the temperature is no less than 190° C., then the flow proceeds to S960 to determine whether or not the flag F3 is set at "1". If F3=0, the subroutine is terminated. If F3=1, then the program proceeds to S970 in which the flags F2 and F3 are reset to "0", and the subroutine of the image forming operation is called in the step S980 to start copying. The flag F3 has the same function as described with reference to the fifth embodiment.

If the flag F2=0 in S320, it means that the image forming operation has been carried out after the turning on of the power switch 62 until the print button 71 is pressed at this time, and there is no need to rotate the rollers in the fixing apparatus for preparation, so that the program directly proceeds to S980 to carry out the image forming operation.

In the sixth and seventh embodiments, the warming up of the machine after the turning on of the power switch 62 is carried out by turning on only the fixing heater lamp 44 serving as the heating means without rotating the heat roller 41 and pressing roller 45 in the fixing apparatus 28. The warming up is terminated when the fixing thermister 48 detects the aimed temperature 190° C. of the heat roller 41 for fixing is reached. Therefore, the warming up can be carried out quietly. When the print button 71 is pressed for the first time, namely, in the first copying operation in the morning, the main motor is driven to rotate the heat roller 41 and the pressing roller 45 being in contact therewith. The temperature distribution between both rollers is made uniform by the heat conduction. The image forming operation is started when the surface temperature of the heat roller 41 which once becomes lower than 190° C. is again raised to be higher than 190° C. Therefore, the fixing can be satisfactorily carried out. The fixing heater lamp 44 contained in the heat roller 41 is on.off controlled during this period so as to maintain the aimed temperature for fixing by temperature adjusting operation routine.

The subroutines of the image forming operation and the image forming terminating operation described in respective embodiments are not the essential part of the present invention as the basic concept thereof are well know. Therefore, detailed description thereof is omitted.

As described above, in the main embodiments of the present invention, the number of copies per unit time period is reduced for a prescribed time period after the end of warming up when the heat stored in the fixing apparatus is not sufficient for fixing, so as to reduce load on the fixing apparatus. In the first and second embodiments, the prescribed time period is set dependent on the prescribed number of copy paper. In the third and fourth embodiments, the time is set by the timer. In the fifth embodiment, the prescribed time period is determined by detecting the temperature of the heat roller 41 itself.

Therefore, unlike the prior art, in the copying machine to which the present invention is applied, the fixing operation is started before the fixing apparatus as a whole reaches a saturation temperature. Consequently, the time required for warming up the copying machine can be reduced, and the warming up can be carried out quietly and there is no possibility of the user being surprised by the driving of the fixing apparatus before the start of the actual copying operation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

image forming means for forming a toner image on a sheet of paper at a prescribed image forming speed;

fixing means for fixing said toner image on said sheet of paper;

said fixing means including a heat roller having heating means for heating said sheet of paper, and a pressing roller rotatable in contact with said heat roller;

driving means for rotating said heat roller and said pressing roller;

a sensor for detecting temperature of said heat roller;

power switch for supplying power to said image forming means;

power supply means for supplying power to said heating means after turning on of said power switch;

inhibiting means for inhibiting operation of said image forming means and of said driving means until a prescribed temperature is detected by said sensor;

counting means for counting the number of sheets on which the image is fixed by said fixing means after inhibition by said inhibiting means is released; and controlling means for reducing said prescribed image forming speed per unit time period until the value of said counter reaches a prescribed the value.

2. An image forming apparatus according to claim 1, further comprising:

paper feeding means for feeding said sheet of paper to said fixing means;

wherein said paper feeding means feeds a plurality of said sheets of paper at a prescribed interval, and said controlling means changes said prescribed interval of said feeding means.

3. An image forming apparatus according to claim 1, further comprising:

paper feeding means for feeding said sheet of paper to said fixing means; wherein said paper feeding means feeds said paper at a prescribed feeding speed, and said controlling means changes said feeding speed of said feeding means.

4. An image forming apparatus, comprising:

image forming means for forming a toner image on a sheet of paper at a prescribed image forming speed;

fixing means for fixing said toner image on said sheet of paper;

said fixing means including a heat roller having heating means for heating said sheet of paper, and a pressing roller rotatable in contact with said heat roller;

driving means for rotating said heat roller and said pressing roller;

a sensor for detecting temperature of said heat roller;

power switch for supplying power to said image forming means;

power supply means for supplying power to said heating means after turning on of said power switch;

inhibiting means for inhibiting operation of said image forming means and of said driving means until a prescribed temperature is detected by said sensor;

counter means for counting a time period after the inhibition by said inhibiting means is released; and controlling means for controlling said image forming means such that said image forming speed per unit time period is reduced until the count value reaches said time period.

5. An image forming apparatus according to claim 4, further comprising:

paper feeding means for feeding said sheet of paper to said fixing means; wherein said paper feeding means feeds a plurality of said sheet of paper by a prescribed interval, and said controlling means changes said prescribed interval of said feeding means.

6. An image forming apparatus according to claim 4, further comprising:

paper feeding means for feeding a sheet of paper to said fixing means; wherein said paper feeding means feeds said sheet of paper at a prescribed feeding speed, and said controlling means changes said feeding speed of said feeding means.

7. An image forming apparatus comprising:

image forming means for forming a toner image on a sheet of paper at a prescribed image forming speed;

fixing means for fixing said toner image on said sheet of paper, said fixing means including a heat roller having heating means for heating said sheet of paper and a pressing roller rotatable in contact with said heat roller;

driving means for rotating said heat roller and said pressing roller;

a sensor for detecting temperature of said heat roller;

power switch for supplying power to said image forming means;

power supply means for supplying power to said heating means after the turning on of said power switch;

inhibiting means for inhibiting operation of said image forming means and of said driving means until a prescribed first temperature is detected by said sensor; and controlling means for controlling said image forming means such that said image forming speed per unit time period is reduced after inhibition by said inhibiting means is released until a second temperature is detected by said sensor.

8. An image forming apparatus according to claim 7, further comprising:

paper feeding means for feeding said sheet of paper to said fixed means; wherein said paper feeding means feeds a plurality of said sheet of paper by a prescribed interval, and said controlling means changes said prescribed interval of said feeding means.

9. An image forming apparatus according to claim 7, further comprising:

paper feeding means for feeding said sheet of paper to said fixing means; wherein said paper feeding means feeds said paper at a prescribed feeding speed, and said controlling means changes said feeding speed of said feeding means, said image forming apparatus further comprising:

temperature setting means for making said first prescribed temperature equal to said second prescribed temperature.

10. An image forming apparatus according to claim 7, further comprising:

temperature setting means for making said first prescribed temperature equal to said second prescribed temperature.

11. An image forming apparatus according to claim 7, further comprising:

paper feeding means for feeding said sheet of paper to said fixing means; wherein said paper feeding means feeds said paper at a prescribed feeding speed, and said controlling means changes said feeding speed of said feeding means.

12. An image forming apparatus comprising:

image forming means for forming a toner image on a sheet of paper;

fixing means for fixing said toner image on said sheet of paper;

said fixing means including a heat roller having heating means for heating said sheet of paper and a pressing roller provided in contact with said heat roller;

driving means for rotating said heat roller and the pressing roller;

a sensor for detecting temperature of said heat roller;

power supply means for supplying power to said heating means;

a power switch for supplying power to said image forming means;

a print switch for outputting an image formation starting signal;

inhibiting means for inhibiting operation of said image forming means after the turning on of said power switch until a detection of a prescribed temperature by said sensor;

counting means for counting a prescribed time period in response to the input of the image formation starting signal; and controlling means for operating said driving means in response to the input of said image formation starting signal for the first time after inhibition by said inhibiting means is released and for starting the operation of said image forming means after the prescribed time period has been counted by said counting means.

13. An image forming apparatus, comprising:

image forming means for forming a toner image on a sheet of paper;

fixing means for fixing said toner image on said sheet of paper;

said fixing means including a heat roller having heating means for heating said sheet of paper, and a pressing roller provided in contact with said heat roller;

driving means for rotating said heat roller and the pressing roller;

a sensor for detecting temperature of said heat roller;

power supply means for supplying power to said heating means;

a power switch for supplying power to said image forming means;

a print switch for outputting an image formation starting signal;

inhibiting means for inhibiting operation of said image forming means after said power switch is turned on until a prescribed first temperature is detected by said sensor; and controlling means for driving said driving means in response to the input of said image formation starting signal for the first time after the inhibition by said inhibiting means is released, and for starting the operation of said image forming means when a prescribed second temperature is detected by said sensor after the input of said image formation starting signal.

14. An image forming apparatus according to claim 13, further comprising:

temperature setting means for making said first prescribed temperature equal to said second prescribed temperature.

15. An image forming apparatus comprising:

image forming means for forming a toner image on a sheet of paper;

fixing means for fixing said toner image on said sheet of paper, said fixing means including a pair of rollers and heating means for heating said rollers;

sensing means for sensing temperature of said fixing means;

power supply means for supplying power to said heating means;

generating means for generating a start signal to start operation of the image forming means;

inhibiting means for inhibiting the generation of said start signal until the temperature of the fixing means has risen a prescribed temperature after starting of the power supply;

driving means for rotating said rollers in response to said start signal;

determining means for determining after the generation of said start signal whether or not the fixing means achieves stable condition by the rotation of said rollers; and control means for starting operation of the image forming means when the fixing means achieves the stable condition.

16. An image forming apparatus, comprising:

image forming means for forming a toner image on a sheet of paper;

fixing means for fixing said toner image on said sheet of paper, said fixing means including a heat roller having heating means for heating said sheet of paper and a pressing roller provided in contact with said heat roller;

driving means for rotating said heat roller and the pressing roller;

detecting means for detecting temperature of said heat roller;

a print switch for outputting an image formation starting signal to start the operation of said image forming means;

control means for operating said driving means and said image forming means when said image formation starting signal is inputted;

counting means for counting a prescribed time period in response to the input of image formation starting signal; and inhibiting means for inhibiting operation of said image forming means after turning on of said print switch until said prescribed time has been counted by counting means.

17. An image forming apparatus, comprising:

image forming means for forming a toner image on a sheet of paper;

fixing means for fixing said toner image on said sheet of paper, said fixing means including a heat roller having heating means for heating said sheet of paper and a pressing roller provided in contact with said heat roller;

driving means for rotating said heat roller and the pressing roller;

detecting means for detecting temperature of said heat roller;

a print switch which when turned on outputs an image formation starting signal to start the operation of said image forming means;

control means for operating said driving means and said image forming means when said image formation starting signal is inputted; and inhibiting means for inhibiting operation of said image forming means after the turning on of said print switch until a prescribed temperature is detected by said detecting means.

* * * * *